United States Patent [19]

Simmons, Jr.

[11] 3,951,178

[45] Apr. 20, 1976

[54] SHUTTLELESS LOOM

[75] Inventor: James W. Simmons, Jr., Atlanta, Ga.

[73] Assignee: Cox Foundry and Machine Co., Atlanta, Ga.

[22] Filed: Dec. 13, 1974

[21] Appl. No.: 532,625

[52] U.S. Cl. ..... 139/446; 139/449

[51] Int. Cl.[2] ..... D03D 47/00

[58] Field of Search ..... 139/116, 122 R, 122 H, 139/123, 124 R, 127 R, 128, 130

[56] References Cited

UNITED STATES PATENTS

| | | | |
|---|---|---|---|
| 3,081,798 | 3/1963 | Stauffer et al. | 139/127 |
| 3,232,321 | 2/1966 | Dewas | 139/123 |
| 3,266,528 | 8/1966 | Liebchen | 139/122 |
| 3,335,760 | 8/1967 | Scheffel | 139/122 |
| 3,610,294 | 10/1971 | Maassen et al. | 139/123 |
| 3,717,182 | 2/1973 | Sparling | 139/127 R |
| 3,734,142 | 5/1973 | Dewas | 139/123 |
| 3,826,289 | 7/1974 | Galkin et al. | 139/127 R |

FOREIGN PATENTS OR APPLICATIONS

| | | | |
|---|---|---|---|
| 952,901 | 3/1964 | United Kingdom | 139/122 R |
| 1,148,263 | 4/1969 | United Kingdom | 139/123 |

*Primary Examiner*—James Kee Chi

*Attorney, Agent, or Firm*—Walter M. Rodgers

[57] ABSTRACT

A shuttleless loom having warp shed forming means and rapier type weft inserting means is provided with lay means which is pivotally mounted for oscillatory beat-up movement on a rotatable shaft, rotation of the shaft being synchronized with beat-up movement of the lay means by lay coupling means and the weft inserting means being interconnected with the shaft by weft inserting coupling means so as to insure a compact structure which is mechanically sturdy and which is timed in such a way as to afford rapid rapier insertion and withdrawal movement together with adequate dwell time for the weft insertion elements and shed forming means during beat-up operations of the lay means.

3 Claims, 2 Drawing Figures

SHUTTLELESS LOOM

It is well known that shuttleless type looms are characterized by faster operation, less inertia and much less noise than shuttle type looms.

In all shuttleless type looms due consideration must be given to the dwell time required to perform beat-up operations and for maintaining the warp shed in order to permit insertion and withdrawal of the weft inserting means whether such means be in the form of rapiers or flexible tapes. Known shuttleless looms require a considerable floor area and of course all loom functions must be properly synchronized.

A shuttleless loom constructed according to one form of the present invention is compact and includes warp shed forming means together with weft inserting means operable in synchronism with the warp shed forming means and lay means. The loom lay is pivotally mounted on a constantly rotatable drive shaft, previously known as the rocker shaft, together with lay coupling means which interrelates rotating movement of the drive shaft and beat-up movement of the lay means as well as weft inserting coupling means which operably interconnects the drive shaft with the weft inserting means all arranged in such manner as to provide an operating cycle which incorporates adequate and necessary dwell time and intervals of high velocity movement as required properly to perform weft inserting and beat-up operations.

Figure 1:
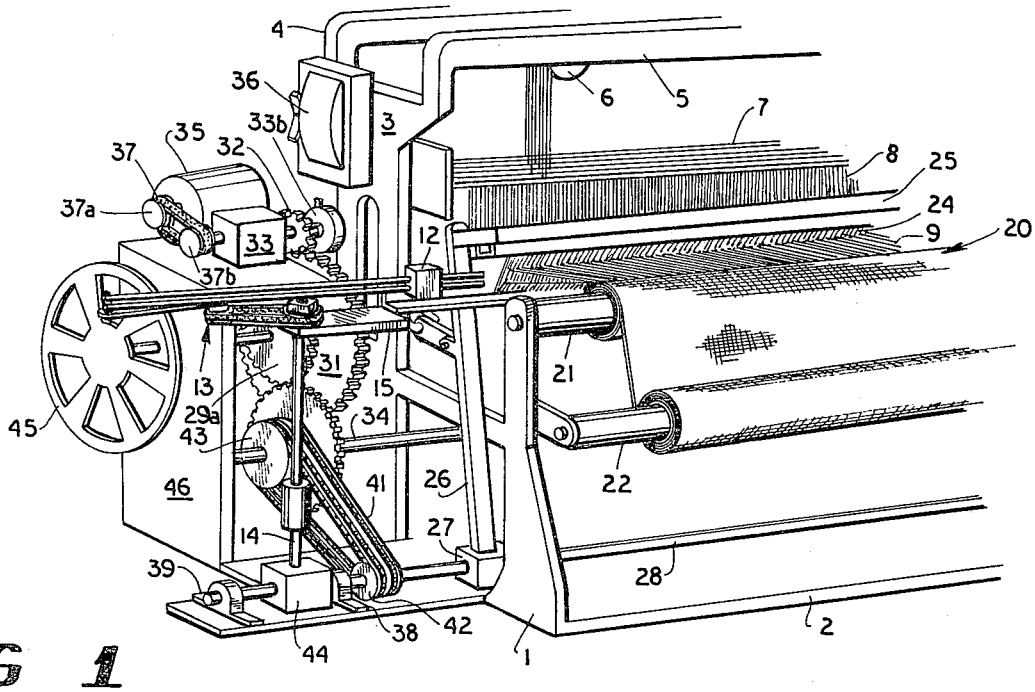
Figure 2:
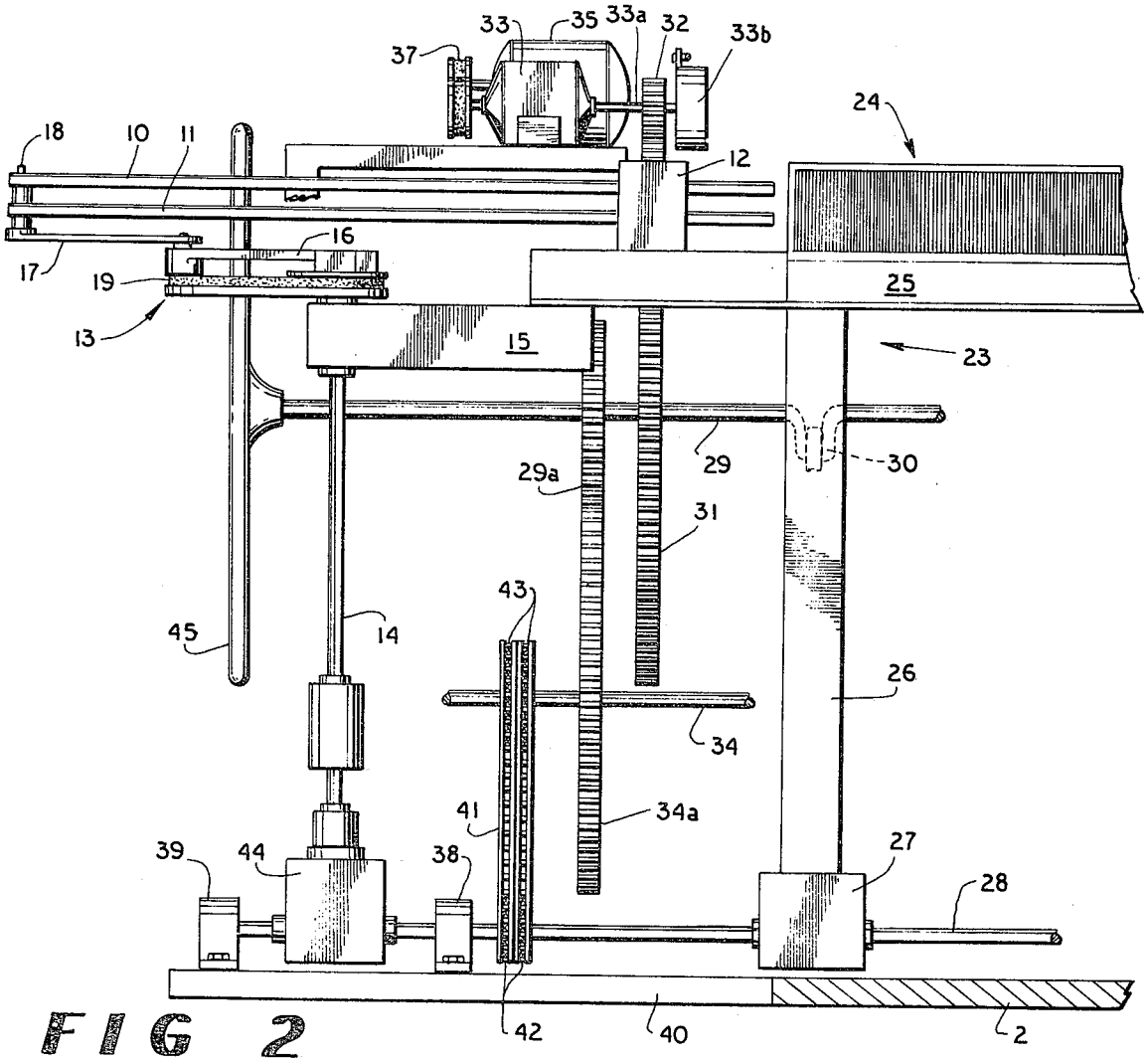

For a better understanding of the invention reference may be had to the following detailed description taken in conjunction with the accompanying drawings in which FIG. 1 is a somewhat schematic perspective view of one end of a shuttleless loom constructed according to the invention and in which FIG. 2 is a schematic front view of the structure shown in FIG. 1 with certain parts removed for clarity.

In the drawings the numeral 1 designates a vertically disposed upright frame element which is secured to a horizontally disposed frame element 2. Integral with vertical frame element 1 is a frame element 3 to the upper parts of which horizontally disposed arch frame elements 4 and 5 are secured.

Conventional warp shed forming means comprises a plurality of sheaves 6 which are rotatably supported in known manner by the arches 4 and 5 and which control vertical reciprocatory motion of harness elements 7 and their associated heddles 8 by which the warp threads 9 are controlled in known manner so as to form warp sheds in sequence.

For the purpose of inserting the weft threads into the warp sheds, rapiers 10 and 11 are reciprocably operated into and out of the shed and are disposed on either side of the loom although FIGS. 1 and 2 disclose only one end of a loom. Operating movement of the swords 10 and 11 is controlled by guides generally designated at 12.

Operating movement is imparted to rapiers 10 and 11 by weft inserting means generally designated by the numeral 13 which is driven by rotatable shaft 14 journally related with support beam 15 to which a fixed gear having exterior teeth is mounted but not clearly shown in the drawings. Fixedly secured to shaft 14 is an arm 16 so that rotation of shaft 14, which extends through the fixed gear mounted on beam 15, imparts rotary movement to arm 16. Pivotally connected at the left hand end of arm 16 is another arm 17 of the same effective length as arm 16 and which in turn at its left hand end as shown in FIG. 2 is pivotally connected at 18 to the rapiers 10 and 11. A belt 19 having internal projections which cooperate with the teeth of the gear fixed on beam 15 imparts rotary movement to a gear not shown but which is secured to a pin connected to the right hand end of arm 17. Thus rotation of shaft 14 imparts rotation to arms 16 and 17 and in turn causes reciprocatory motion to rapiers 10 and 11. For a more complete description of the structure and operation of weft inserting means 13, reference may be had to U.S. Pat. No. 3,335,760 issued Aug. 15, 1967 and captioned "Gripper Loom."

As is well understood, a weft thread connected to the inner end of a rapier such as 10 is fed into the shed approximately half way across and is transferred to a corresponding rapier which enters the shed from the opposite side and which when retracted completes the travel of the weft thread across the shed. Thus sequential formation of sheds followed by synchronous insertion of the rapiers such as 10 and 11 results in the weaving of a double pile cloth designated in FIG. 1 by the numeral 20 and which is cut into two single thickness layers by known means not shown. The lower layer is wound on the horizontal loom roller 21 and the upper layer is wound on roller 22.

While the invention is illustrated in the drawings in conjunction with two rapiers such as 10 and 11, it will be understood that the invention is applicable to apparatus for weaving flat type fabrics as well as double fabrics in which case only one rapier such as 10 or 11 is employed.

In order to beat-up the weft threads into the finished body of the cloth 20, lay means generally designated by the numeral 23 is employed. Of course lay means 23 includes reed structure 24 mounted atop beam 25 which in turn is secured to vertical support element 26 which in turn is oscillatable through bearing structure 27 on rotatable shaft 28. A corresponding element such as 26 is not shown but is disposed at the right hand end of the loom as viewed in both figures of the drawing.

For the purpose of imparting oscillatory beat-up motion to the lay means 23 about shaft 28 as a center, a crank shaft 29 is interconnected as schematically indicated at 30 with element 26. Shaft 29 is mounted in bearings (not shown) which are secured in any suitable manner to the frame structure of the loom. Rotary motion is imparted to shaft 29 by any suitable means such as driven gear 31 secured to shaft 29 and which cooperates with a driving gear 32 fixedly mounted on shaft **33*a* of clutch 33 coupled with motor 35 by belt or chain 37 and associated pulleys or pinions 37*a* and 37*b*. Motor 35 is secured to the frame structure in any suitable manner and controlled by control means 36 also mounted to the frame of the machine. A brake 33*b* is arranged to cooperate with shaft 33*a* to aid in arresting rotation of gear 32** and associated parts.

Shaft 28 is rotated in synchronism with the lay although this shaft is not directly coupled with the lay means. Thus the crank shaft 29 is coupled with shaft 34 through driving gear **29*a* secured to shaft 29 and driven gear 34*a* secured to shaft 34, the gears 29*a* and 34*a* being in meshed relation with each other and the number of teeth on gear 34*a* being twice that of gear 29*a*. Shaft 34 is rotatably mounted in bearings (not shown) but which are secured to the machine frame. As is apparent from the drawings, rotation of motor 35 and of clutch 33 drives gears 32 and 31 and in turn rotates shaft 29, gears 29***a* and 34*a* and shaft 34. Rotation of shaft 34 imparts rotation to shaft 28 through chain 41 and sprockets 42 and 43. Sprocket 43 is twice as large in diameter as sprocket 42.

According to one feature of this invention shaft 28 is mounted in fixed bearings 38 and 39 which are secured to base plate 40 which is fixed in position with respect to frame 1 and which conveniently may rest on the supporting floor. Interconnection between rotatable shaft 28 and rotatable shaft 34 and all of the mechanism associated with the lay means is effected by means of a lay coupling double chain designated by the numeral 41 which cooperates with the sprocket 42 affixed to shaft 28 and the sprocket 43 affixed to shaft 34. Thus rotation of shaft 28 is in coordination with operation of the lay means 23 and is effected by lay coupling means in the form of chain 41 and sprockets 42 and 43.

For the purpose of imparting operating rotation to shaft 14, a gear box 44 is coupled with shaft 28 and constitutes, together with shaft 14, weft inserting coupling means whereby shaft 28 is coupled with weft inserting means 13 in accordance with another feature of this invention. Gear box 44 includes meshing pinions one of which is affixed to shaft 28 and the other of which is affixed to shaft 14. These pinions are of the same size.

For controlling the operation of the loom manually, a wheel 45 is mounted on crank shaft 29.

As is well known rotation of crank 29 due to its coupling 30 with the vertical element 26 results in oscillatory movement of lay means 23 as is well known. It is also apparent that according to the invention substantial space economy is achieved by the dual function of shaft 28 which not only serves to impart operating movement to weft inserting coupling means whereby operation of weft inserting means 13 is correlated with beat-up action by lay means 23, shaft 28 also serves as a pivot about which the lay means 23 and the weft coupling means 14 and 44 oscillate. Thus according to the invention substantial space economy is achieved.

The embodiments of the invention in which an exclusive property or privilege is claimed are defined as follows:

1. A shuttleless loom comprising means for sequentially forming warp sheds, fixedly mounted bearing means, a shaft rotatably mounted on said bearing means, lay means pivotally mounted on said shaft for oscillatory movement about the axis thereof and in synchronism with the formation of warp sheds, lay coupling means operably interconnecting said shaft and said lay means for imparting synchronous rotary movement to said shaft relative to oscillatory movement of said lay means, weft inserting means mounted on said lay means and including rotatable elements, and weft coupling means including a gear box mounted on and coupled with said shaft and a second rotatable shaft driven from said gear box and journally related with said lay means for imparting rotary motion to said rotatable elements of said weft inserting means which is in synchronism with oscillation of said lay means and with the formation of warp sheds whereby weft threads are inserted into the sheds.

2. A shuttleless loom according to claim 1 wherein guide means is mounted on said lay means and cooperates with said rapier means to aid in controlling the movement and orientation thereof.

3. A shuttleless loom according to claim 1 wherein said weft inserting means includes transversely reciprocable rapier means.

* * * * *